US006053402A

United States Patent [19]

Thomas et al.

[11] Patent Number: 6,053,402

[45] Date of Patent: Apr. 25, 2000

[54] MULTI-COMPARTMENT CARTON

[76] Inventors: Daniel Thomas, 1944 Victory Dr., Baltimore, Md. 21227; Michael Vernon Zeller, 2301 Dorsey Rd., Suite 208, Glen Burnie, Md. 21061

[21] Appl. No.: 09/160,236

[22] Filed: Sep. 25, 1998

[51] Int. Cl.[7] ..... B65D 5/48; B65D 5/54; B65D 5/40

[52] U.S. Cl. ..... 229/120.011; 229/120.21; 229/120.32; 229/122; 229/125.42; 229/162; 229/235

[58] Field of Search ..... 229/120.03, 120.011, 229/120.21, 120.32, 122, 125.42, 162, 235

[56] References Cited

U.S. PATENT DOCUMENTS

| | | | |
|---|---|---|---|
| 1,791,094 | 2/1931 | Albert | 229/120.03 |
| 2,083,114 | 6/1937 | Blechman . | |
| 2,287,729 | 6/1942 | Fallert . | |
| 2,290,971 | 7/1942 | King . | |
| 2,321,660 | 6/1943 | Courtney | 229/162 |
| 2,327,529 | 8/1943 | Keckhefer et al. . | |
| 2,361,852 | 10/1944 | Locke, Jr. | 229/122 |
| 2,487,293 | 11/1949 | Belsinger . | |
| 2,640,623 | 6/1953 | Ryder . | |
| 2,643,811 | 6/1953 | Bolding | 229/162 |
| 2,709,519 | 5/1955 | Cushman . | |
| 2,750,096 | 6/1956 | Misch | 229/162 |
| 2,802,614 | 8/1957 | Gelin . | |
| 3,113,668 | 12/1963 | Taylor . | |
| 3,186,622 | 6/1965 | Palmer | 229/120.03 |
| 3,322,265 | 5/1967 | Collura | 229/162 |
| 3,343,746 | 9/1967 | Shiffman . | |
| 3,490,678 | 1/1970 | James et al. | 229/162 |
| 3,685,640 | 8/1972 | Tolaas | 229/120.32 |
| 3,690,523 | 9/1972 | Link | 229/162 |
| 3,773,248 | 11/1973 | Cecil et al. | 229/235 |
| 4,377,237 | 3/1983 | Pawlowski . | |
| 5,180,079 | 1/1993 | Jeng . | |
| 5,464,151 | 11/1995 | Parker et al. | 229/235 |
| 5,514,394 | 5/1996 | Lenahan . | |

FOREIGN PATENT DOCUMENTS

| | | | |
|---|---|---|---|
| 227644 | 1/1925 | United Kingdom | 229/120.03 |

*Primary Examiner*—Gary E. Elkins
*Attorney, Agent, or Firm*—Smith, Gambrell & Russell, LLP

[57] ABSTRACT

A multi-compartment carton includes at least a first compartment and a second compartment coupled to the first compartment. An internal wall of the carton separates the compartments. In one embodiment, at least one of the compartments has a transparent viewing window. In another embodiment, the compartments are separable. Preferably, the first compartment is suitable for holding and dispensing a liquid, while the second compartment holds a solid food material.

13 Claims, 4 Drawing Sheets

MULTI-COMPARTMENT CARTON

BACKGROUND OF THE INVENTION

1. Field of the Invention

This invention relates to packaging and more particularly to a multi-compartment carton for separately holding multiple materials within the same carton.

2. Description of the Prior Art

Packaging which allows multiple substances, such as cereal and milk, to be held in separate compartments in one package, has been known in the art. For instance, U.S. Pat. No. 5,514,394 issued to Lenahan describes a cereal package that includes an upper and a lower compartment, and a membrane separating the two compartments. Compression of the package causes rupture of the membrane. Such rupture allows the liquid contents of the upper portion to flow into the bottom compartment.

U.S. Pat. No. 3,343,7406 issued to Shiffman discloses stackable containers connected by a pull tab. Pulling the tab permits separation of the composite container package into individual containers, each of which can be given to a different person.

Similarly, U.S. Pat. No. 3,113,668 issued to Taylor discloses a unitary can package having a tubular can body. In the separate cans, food items such as chow mein on crisp noodles can be contained separately and later mixed by the consumer.

The multiple compartment carton described in U.S. Pat. No. 4,377,237 issued to Pawlowski is said to permit one of multiple individual units of food to be removed without damage to other units.

The combined cup disclosed in U.S. Pat. No. 5,180,079 issued to Jeng has an upper portion for solid snacks and a lower portion for holding liquid. A straw gives access to the liquid in the lower portion.

The prior art still lacks a very simple and easy to manufacture multi-compartment container. While the two-compartment container of U.S. Pat. No. 5,514,394 securely prevents the milk and cereal from mixing before mixture is effected by the consumer, the package of this patent is complex in requiring the special rupturable membrane between the upper and lower compartments thereof. Also, none of the U.S. Pat. Nos. 5,514,394; 3,343,746; 3,113,668; 4,377,237; or U.S. Pat. No. 5,180,079 suggests a glassine window for viewing of dry food materials in one of the compartments. Further still, packaging such as cans of the type shown in U.S. Pat. No. 3,113,668 requires household tools in order to open each of the cans and therefore such packaging is appropriate only for home use.

SUMMARY OF THE INVENTION

The present invention pertains to a multi-compartment carton which is simple to use and relatively simple to manufacture. Preferably, the entire carton is fabricated from inexpensive paper or cardboard material, and most preferably, from a waxed paper board material.

The carton of the present invention has a first or upper compartment provided to enclose a liquid therein. In the preferred embodiments, such first compartment would be fabricated from a waxed paper board to ensure liquid-proof sealing. A second or lower compartment of the conta ner is provided below the first compartment and forms the base of the carton. In one preferred embodiment, the upper and lower compartments are not detachable and therefore, with the exception of a transparent window portion on one of the compartments, the container has a unitary body. In another embodiment, the upper and lower compartments are separable.

Dispensing means are located on the first compartment for dispensing liquid from that compartment. The dispensing means are arranged to give the carton the appearance of a conventional milk carton configuration, with a conventional milk carton type pouring spout structure.

The upper compartment is formed by the dispensing means, four side walls and a bottom. The bottom wall of the upper compartment can serve as the top wall of the lower compartment and so the second compartment of carton does not itself require a top wall. The present invention has a relatively simple design which does not require any special membrane between the upper and lower compartments.

The carton of the present invention also is contemplated to have a transparent window such as a glassine window to permit viewing into at least one of the compartments. In the preferred embodiment, the window is located in the lower compartment which is contemplated as reserved for solid foods such as cereal or cookies. The upper compartment is ideal for holding milk. The window permits a consumer to view the contents of the compartment prior to a purchase. Where the contents of the windowed compartment are always to be a solid food material such as cereal or cookies, the window itself may be made removable by a pull tab or the like to permit finger access into the compartment after removal of the window material.

In the embodiment where the upper and lower compartments are separable, they can be secured together by various means. Adhesive materials, or pull tabs are contemplated for this purpose.

DETAILED DESCRIPTION OF THE PREFERRED EMBODIMENTS

Figure 1:
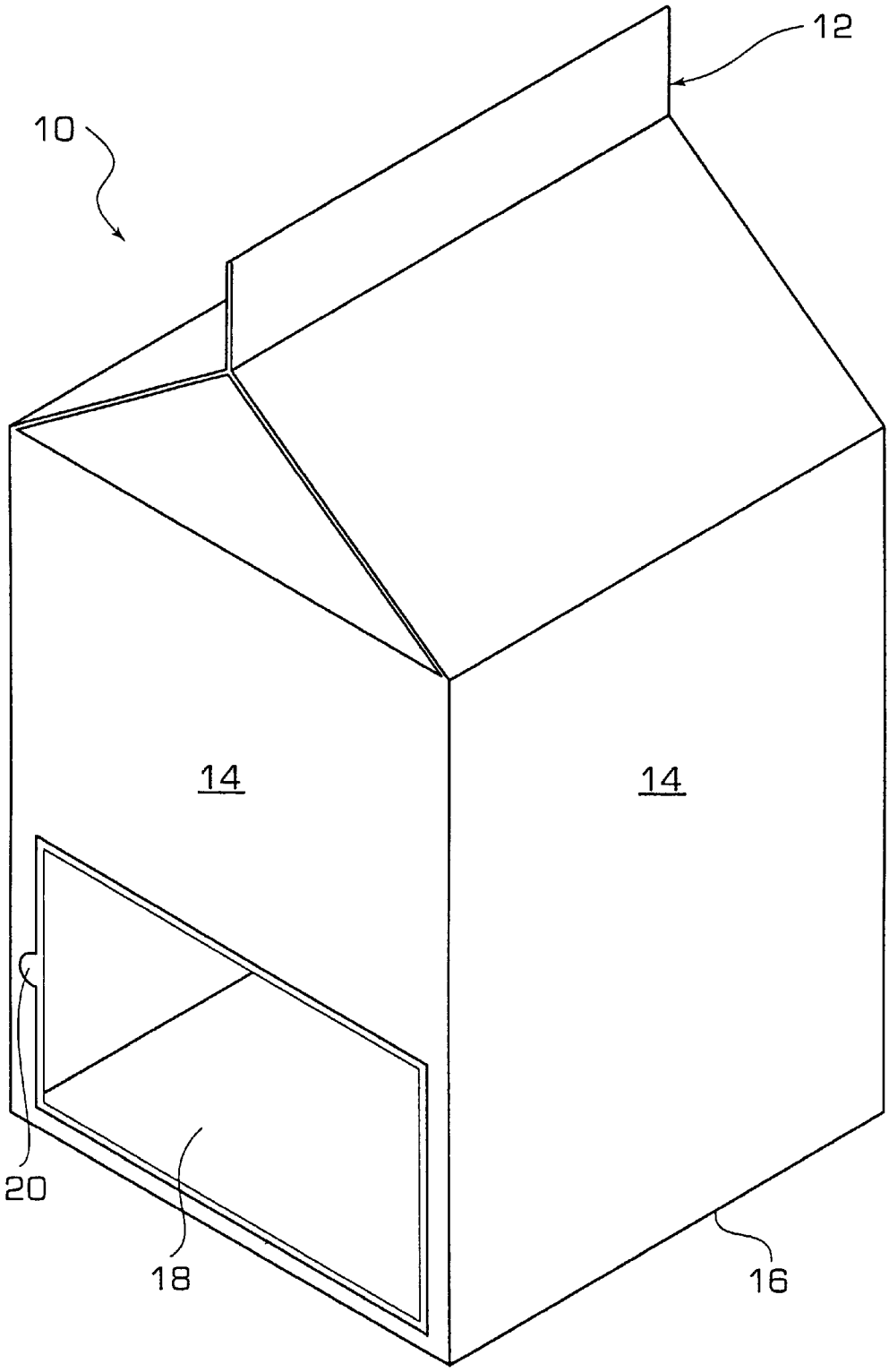
FIG. 1 is a perspective view of a multi-compartment carton in accordance with the present invention.

In perspective view, FIG. 1 shows a first preferred embodiment of the carton 10 in accordance with the present invention. As seen from FIG. 1, carton 10 generally appears similar to a conventional milk carton. Carton 10 has a conventional, press formed, openable spout structure 12 at its top, four side walls 14, and a bottom 15. Spout 12 is operable by finger pressure in the conventional way. It will be apparent to those of ordinary skill in the art that other spout structures such as a screw-on cap, pull-off cap or the like can be employed as well.

A transparent window 18 is located in the lower portion of carton 12. Window 18 preferably is formed of an air-tight transparent glassine or plastic material that is held by adhesive or the like to the side wall 14. The material of window 18 forms a pull tab 20 on the side thereof to permit a purchaser's access to the contents behind the window by removal of the window material.

Figure 2:
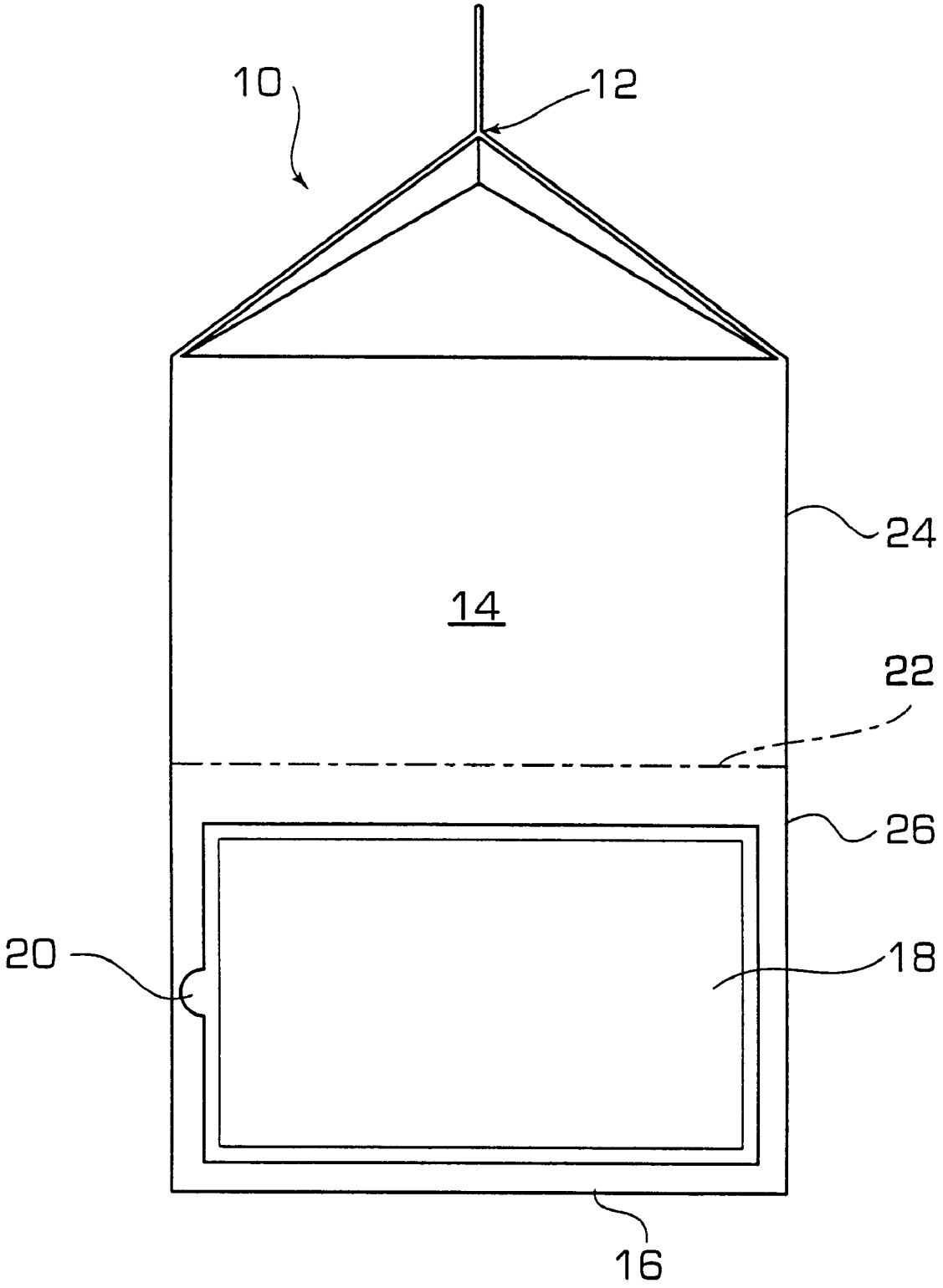
FIG. 2 is a front view of the carton of FIG. 1 with the internal separating wall between the compartments shown in phantom.

With reference to FIG. 2, an internal separating wall 22 is shown in phantom. This internal wall 22 divides carton 10 into an upper compartment 24 and a lower compartment 26. Wall 22 is contemplated as of the same material as at least the upper compartment 24. It serves merely to isolate the two compartments 24 and 26 in a liquid-tight manner. This is because preferred carton 10 is contemplated as holding a liquid such as milk in the upper compartment 24, and solid foods in the lower compartment 26. Hence, at least the upper compartment 24 is made of a suitable material for holding a liquid, such as wax paper board, and has the spout structure 12 for dispensino the liquid from the compartment.

Lower compartment 26 has a ceiling provided by internal wall 22, a bottom provided by the carton bottom 16, and side walls provided by carton sides 14. Sealed glassine window 18 also provides a portion of one side wall of the lower compartment 26. Provided with window 18, lower compartment 26 is contemplated as holding cereal or cookies which will be presented in plain view of the consumer. Window 18 is removable by pulling force applied to pull tab 20 to permit consumption of the contained foods after the carton and its contents have been purchased.

Figure 3:
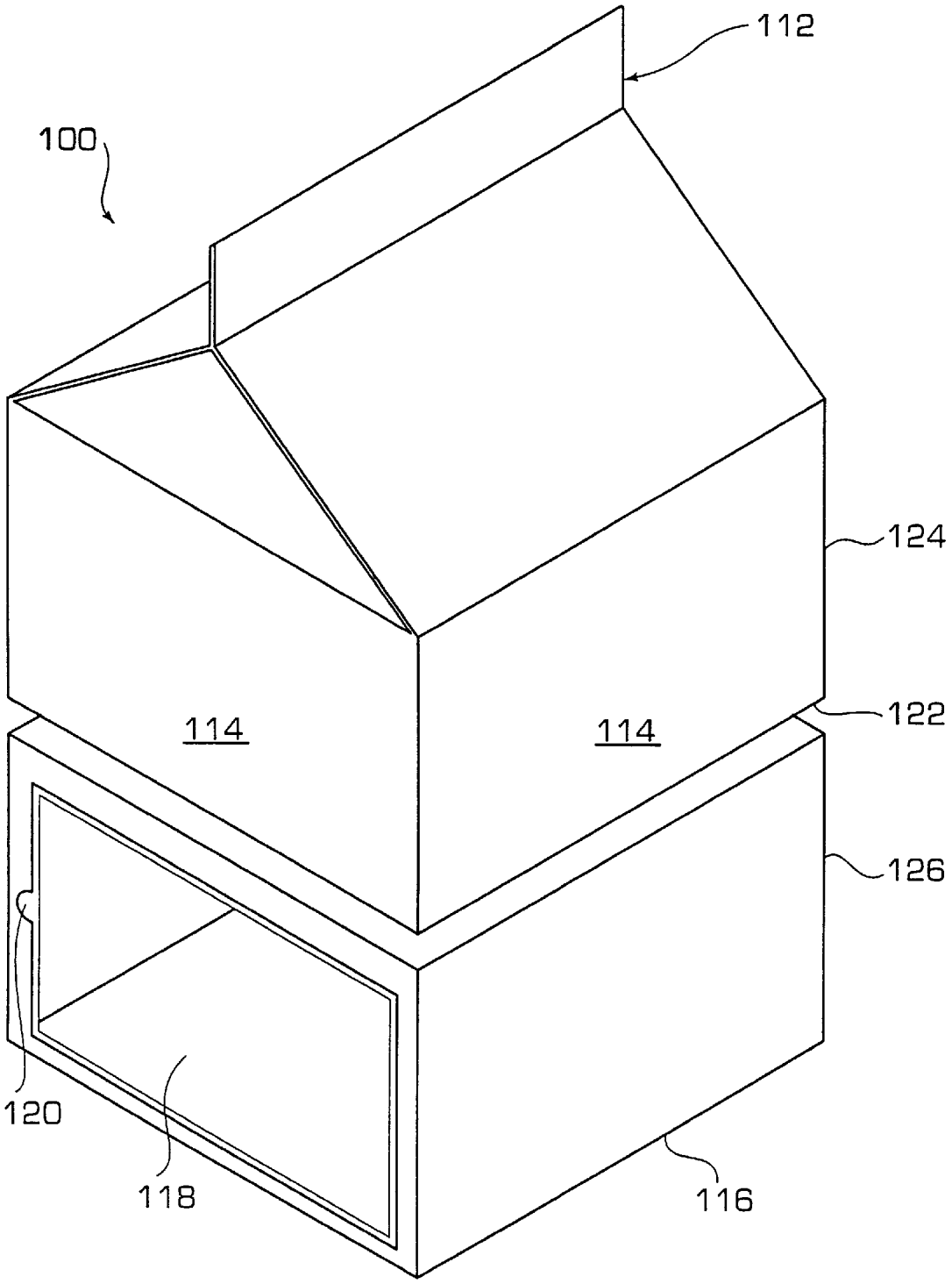
FIG. 3 is a perspective, exploded view showing the two separated compartments of a second embodiment of a multi-compartment carton in accordance with the present invention.

While carton 10 of FIGS. 1 and 2 generally is unitary, FIG. 3 shows an alternative embodiment in accordance with the present invention where the multiple compartments are separable. In carton 100 of FIG. 3, the upper and lower compartments 124 and 126 are separable by a perforated strip 130 or the like which holds them together while the product is displayed for sale. Upper compartment 124 is arranged as discussed in connection with carton 10 with internal wall 122 providing a liquid-proof bottom portion therefore. In the preferred carton 100 then, the lower compartment 126 has only four sides and the carton bottom 116 when separated from upper compartment 124. Alternatively, as apparent, lower compartment 126 also could be formed to have its own top enclosure. In this case, carton 112 would have two such internal walls.

Where lower compartment 126 omits its own top wall as shown, the mere separation of upper compartment 124 therefrom effects complete opening of the lower compartment. Thus all that is needed after compartments 124 and 126 are separated is to open the spout 112 of the upper compartment to ready the contained food products for consumption. Where lower compartment 126 contains cereal, it is contemplated that this compartment also be constructed from wax paper board so that milk from upper compartment 124 can be poured into the cereal for consumption.

Figure 4:
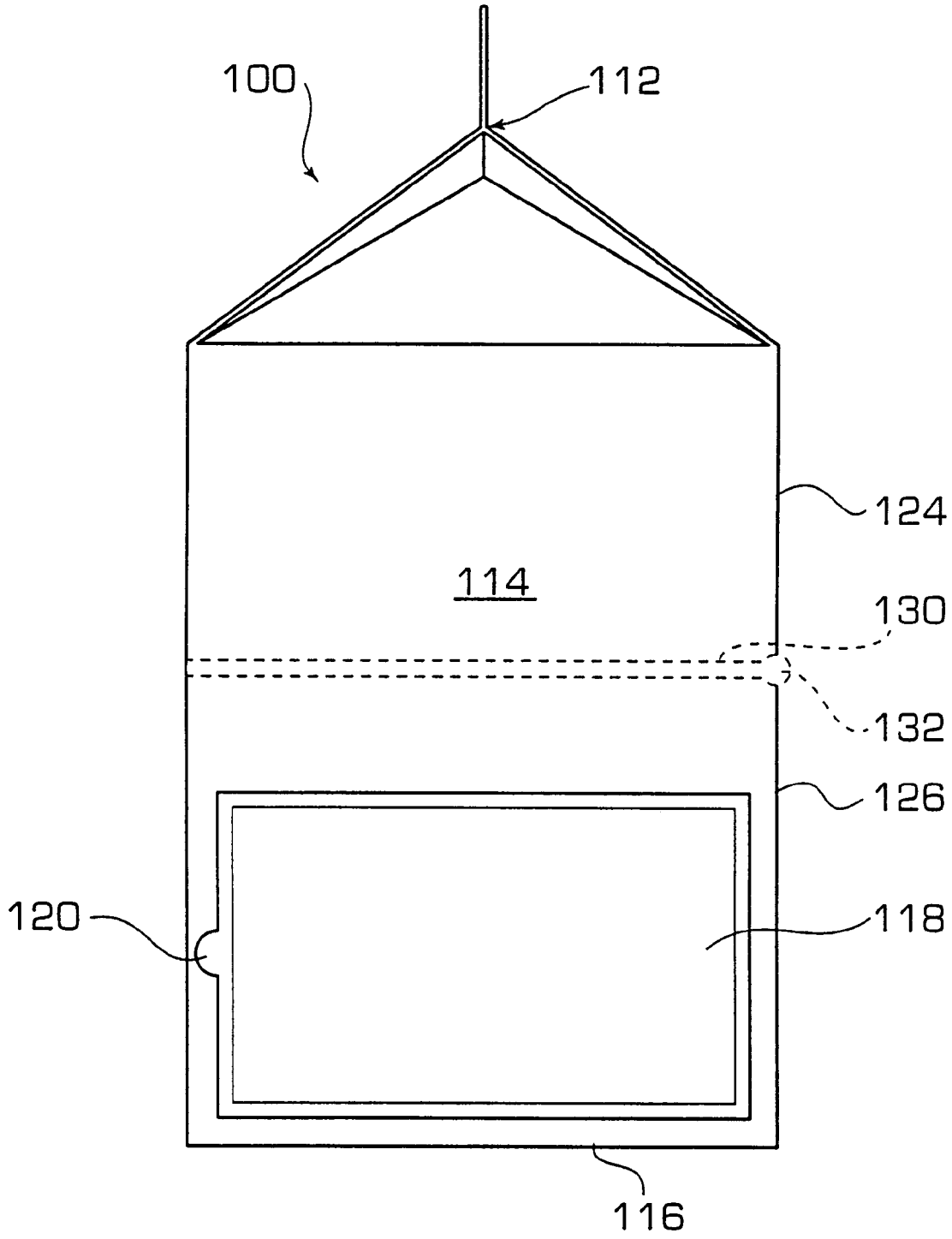
FIG. 4 is a front view of the carton of FIG. 3 which also shows a perforated strip connecting the upper compartment and the lower compartment of the carton.

With respect to FIG. 4, in this exemplary embodiment, the upper compartment 124 and the lower compartment 126 are separably coupled together by a conventional perforated strip 130. A finger-grip tab 132 also is shown on strip 130. Alternatively, an adhesive tape or the like can be substituted for strip 130. Further still, an adhesive could be provided between the compartments 124 and 126 to hold carton 100 together until purchased.

FIGS. 3 and 4 also show the lower compartment 126 with a transparent window IS8 for viewing and/or providing access to the contents of the lower compartment. Again, the window 118 is depicted as provided with a pull tab 120 for removal of the window for finger access to the lower compartment 126. If desired, the window 118 could be provided on either or both of the container compartments 124, 126.

While the preferred embodiments of the present invention have been shown and described, it is to be understood that this disclosure is for the purpose of illustration and that various changes and modifications may be made without departing from the scope of the invention as set forth in the appended claims.

We claim:

1. A multi-compartment carton comprising:

side walls;

a sealed upper portion connected to said side walls;

a bottom portion connected to said sidewalls to form an enclosure with said side walls and said sealed upper portion;

an internal wall defining first and second compartments within said carton that are isolated from each other; and transparent window means on one of said side walls for permitting viewing of contents within one of said compartments while maintaining said one compartment in sealed condition.

2. The multi-compartment carton defined in claim 1 wherein said window means includes a glassine window.

3. The multi-compartment carton defined in claim 2 wherein said glassine window is attached to said one side wall by an adhesive and said window has a pull tab for opening thereof.

4. The multi-compartment carton defined in claim 3 wherein said carton generally is unitary.

5. The multi-compartment carton defined in claim 1 wherein said first compartment and said second compartment are separable.

6. The multi-compartment carton as defined in claim 1 wherein said first compartment is an upper compartment and said second compartment is a lower compartment, and said bottom of said upper compartment provides a top for said lower compartment while said compartments are coupled.

7. The multi-compartment carton as defined in claim 6 wherein said sealed upper portion includes an openable spout.

8. A multi-compartment carton comprising:

a first compartment including a top portion, a bottom portion, and sides connecting said top and bottom portions for forming an enclosure for containing a liquid therein;

a second compartment separably coupled to said first compartment and including at least sides and a bottom portion connected to each of said second compartment sides; and a spout means located on said first compartment for dispensing liquid from said first compartment to said second compartment after said second compartment has been decoupled from said first compartment.

9. The multi-compartment carton defined in claim 8 further comprising a transparent window on said second compartment.

10. The two-compartment carton defined in claim 8 wherein said window removably is attached to one of said sides of said second compartment and said window has a pull tab for opening thereof.

11. The multi-compartment carton defined in claim 8 wherein said first compartment and said second compartment are coupled by one of a perforated strip and an adhesive tape.

12. The multi-compartment carton as defined in claim 11 wherein said first compartment is an upper compartment and said second compartment is a lower compartment, and said bottom of said upper compartment provides a top for said lower compartment while said compartments are coupled.

13. The multi-compartment carton as defined in claim 8 wherein said spout means is a milk carton type openable spout.

* * * * *